US006404307B1

(12) United States Patent
Wulff

(10) Patent No.: US 6,404,307 B1
(45) Date of Patent: Jun. 11, 2002

(54) RESONANT CAVITY COUPLING MECHANISM

(75) Inventor: Torsten R. Wulff, Medford, OR (US)

(73) Assignee: Kathrein, Inc., Scala Division, Medford, OR (US)

( * ) Notice: Subject to any disclaimer, the term of this patent is extended or adjusted under 35 U.S.C. 154(b) by 17 days.

(21) Appl. No.: 09/723,857

(22) Filed: Nov. 28, 2000

Related U.S. Application Data

(60) Provisional application No. 60/169,188, filed on Dec. 6, 1999.

(51) Int. Cl.[7] ..... H01P 1/202; H01P 1/20

(52) U.S. Cl. ..... 333/207; 333/230; 333/235

(58) Field of Search ..... 333/230, 231, 333/232, 235, 206, 207, 208, 209, 212, 223, 224, 226, 203, 202, 219.1

(56) References Cited

U.S. PATENT DOCUMENTS

| | | | | |
|---|---|---|---|---|
| 4,639,699 A | * | 1/1987 | Nishikawa et al. | 333/202 |
| 4,652,844 A | * | 3/1987 | Brambilla | 333/212 |
| 4,686,494 A | | 8/1987 | Kaneko et al. | 333/137 |
| 5,691,675 A | | 11/1997 | Hatanaka | 333/202 |
| 5,805,033 A | | 9/1998 | Liang et al. | 333/202 |
| 5,841,330 A | | 11/1998 | Wenzel et al. | 333/202 |

* cited by examiner

*Primary Examiner*—Robert Pascal
*Assistant Examiner*—Stephen E. Jones
(74) *Attorney, Agent, or Firm*—Flehr Hohbach Test Albritton & Herbert LLP

(57) ABSTRACT

A coupling mechanism for coupling adjacent cavities which includes a window having side walls joining two cavities and a coupling member extending into said window between said side walls. The coupling member is movable between said side walls to adjust the coupling.

4 Claims, 2 Drawing Sheets

RESONANT CAVITY COUPLING MECHANISM

RELATED APPLICATIONS

This application claims priority to U.S. Provisional Application Serial No. 60/169,188 filed Dec. 6, 1999, which is incorporated herein by reference.

BRIEF DESCRIPTION OF THE INVENTION

This invention relates generally to a coupling for resonant cavities and more particularly to a coupling mechanism.

BACKGROUND OF THE INVENTION

An RF resonant cavity (or multiple interconnected cavities) can be used to create RF filters. The filters may either pass a RF signal over a limited frequency range (a bandpass filter) or exclude an RF signal over a limited frequency range (a notch or bandstop filter), depending upon how the resonator is connected to the overall system. A perfect single cavity device would operate at a single, specific frequency (the resonant frequency), however due to material and other considerations all resonant frequency devices operate over a frequency range which encompasses the resonant frequency.

One type of RF resonator is realized by having a conductive post within an enclosed conductive cavity. The post is connected to the housing at one end and extends towards the top of the cavity. Generally, the resonant frequency of the cavity is selected by adjusting the length of the post.

As mentioned previously, a single resonant cavity only passes energy over a very limited range of input frequencies. A practical device needs to allow energy over a broad range of frequencies to pass, while still blocking energies above and below this frequency range. This is accomplished by combining or coupling multiple cavities together. This causes the filter response curve to widen about the resonant frequency.

The cavities are combined by coupling a portion of the energy from one cavity into an adjacent cavity. Standard equations, tables or design guidelines are used which describe the amount of energy that must be coupled in order to realize a given performance goal. The energy is coupled by opening a window or iris between two adjacent cavities, so that the electromagnetic field within one cavity creates a field within the other cavity. The physical size and location of the iris is what controls the amount of energy coupled between the adjacent cavities.

Due to limitations in the ability to manufacture a perfect device, it is necessary to have a method or means for adjusting the energy coupled through the iris. Any obstruction or protrusion in the iris will affect the coupling between the cavities. The obstruction acts as a magnifier for the energy, increasing the amount of energy coupled between the cavities. By altering the relative size or location of the obstruction within the iris it is possible to adjust the coupling to satisfy the given performance requirements.

Typically the adjustment of the coupling is accomplished by using a threaded rod extending from the lid or housing into the iris. U.S. Pat. Nos. 5,841,330 and 5,805,033 show typical coupling mechanisms. The end of the rod may be either straight, as shown in the '330 patent, or it may have a disk or other protrusion at its end, as shown in the '033 patent. Tuning is accomplished by moving the rod into or out of the iris, until the desired performance is met. The rod is then locked in position using a locking nut. This tuning method is undesirable because it requires sufficient room be provided for the portion of the rod that extends above the surface of the filter, thus increasing the overall size of the space required to house the resonator.

A threaded rod decreases the voltage stability of the device. The coupling element is located in an area of high electric field strength. The sharp profile of the thread can not support a high electric field without breakdown.

OBJECTS AND SUMMARY OF THE INVENTION

It is an object of the present invention to provide an improved mechanism for coupling resonant cavities.

It is a further object of the present invention to provide a compact coupled cavity resonator.

It is still another object of the present invention to provide an iris coupled cavity resonator which can be operated with high electric fields at the coupling iris.

There is provided a cavity resonator including a housing having interior cavities with top and bottom walls in which adjacent cavities are coupled to one another through a coupling window having spaced sidewalls and a smooth coupling element supported from the top wall in said window for lateral adjustment with respect to the side walls.

BRIEF DESCRIPTION OF THE DRAWINGS

The foregoing and other objects of the invention will be more clearly understood from the following description when read in conjunction with the accompanying drawings in which.

DESCRIPTION OF PREFERRED EMBODIMENT(S)

Figure 1:
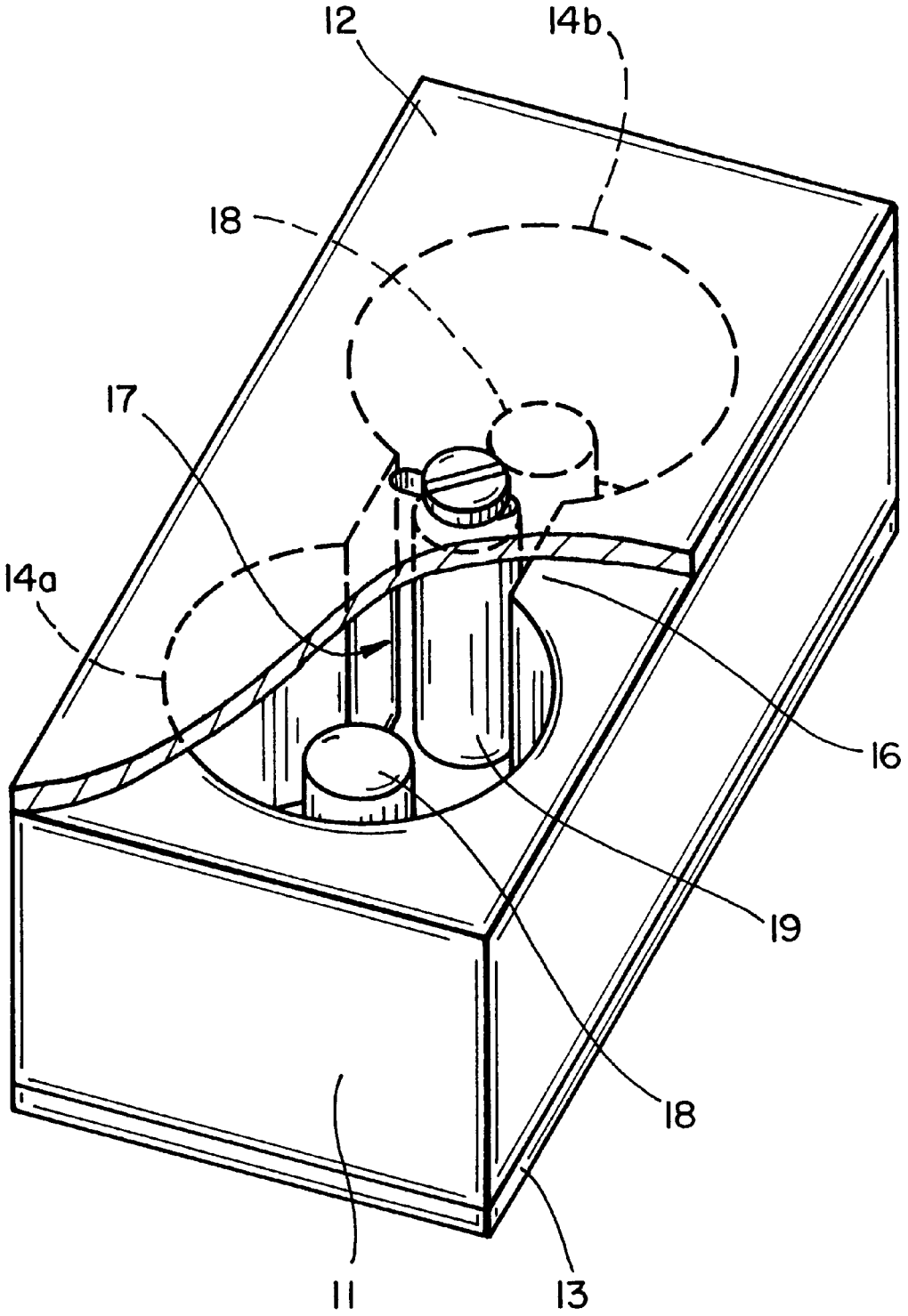
FIG. 1 is a perspective view of a two-cavity resonator with the top partially broken away to show the coupling window and coupling element.
Figure 2:
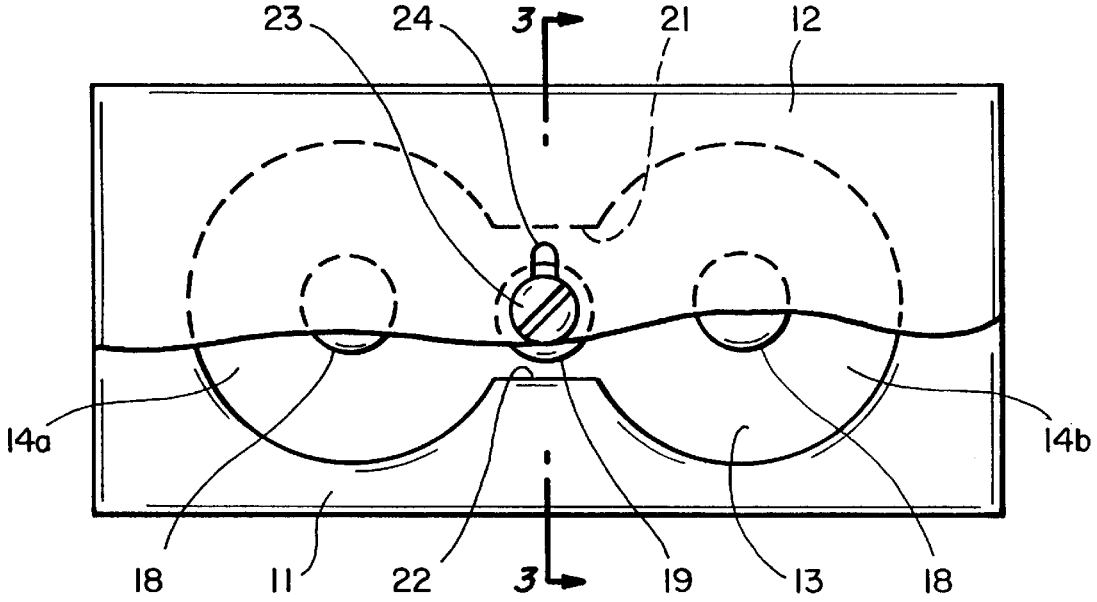
FIG. 2 is a top plan view of the two-cavity resonator with the top partly broken away to show the interior.
Figure 3:
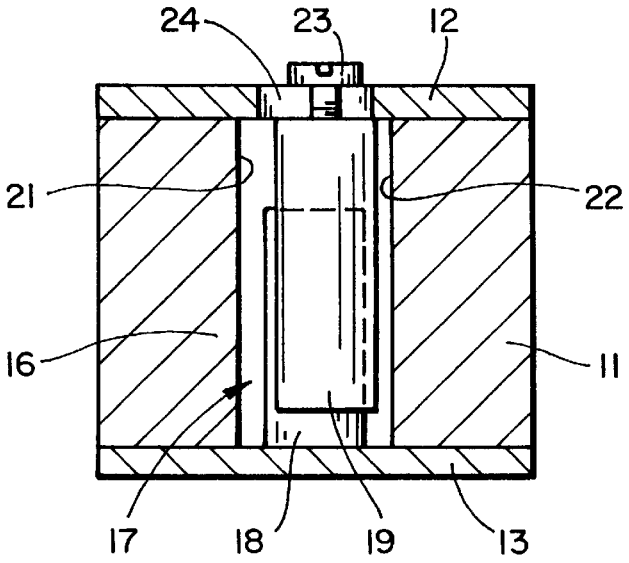
FIG. 3 is a sectional view taken along the line 3—3 of FIG. 2.

Referring to the figures, the resonator or filter includes a housing 11 having top and bottom walls 12 and 13, The housing 11 with conductive cavities 14 can be formed by casting material such as aluminum or by machining a block of aluminum. The housing may also be cast from non-conductive material such as plastic with the interior portions of the housing coated with a conductive material. In the present example, the housing includes adjacent cavities 14*a* and 14*b*. The cavities are separated by a transverse portion 16 which includes a coupling window or iris 17 joining the two cavities. In order to define a cavity resonator for each cavity, a center post 18 extends from the bottom upwardly towards the top. The size of the post and spacing of the post from the top wall 12 determines the resonant frequency of each cavity resonator.

In accordance with the present invention, a coupling element 19 is disposed between the lateral walls 21 and 22 of the coupling window. The coupling member is mounted on the top wall by a screw 23 which extends through the top wall through an elongated slot 24. As a consequence, the coupling element can be laterally moved toward and away from the side walls of the coupling window. The coupling element has smooth walls reducing the possibility of forming high electric breakdown fields as would be common with the threaded members of the prior art. The extension of the screw through the slot 24 provides the lateral adjustment. It is observed that the resonator is compact, having no member extending any distance from the top wall, thereby providing a compact resonator which requires minimum space.

The maximum coupling occurs when the coupling element is in the center of the iris or window 17. The coupling element allows adjustment over a substantially wide range to accommodate any manufacturing-induced errors in the cavities or windows. The coupling element is easily moved by unscrewing the screw and moving the element to obtain the desired performance where the element can then be fixed in position. Another benefit of the present invention is that the larger coupling element provides better coupling, permitting the use of smaller windows or irises between adjacent cavities. To obtain similar performance in the prior art, it would be necessary to increase the iris size significantly. Increasing the iris or window size degrades the performance of the device at higher frequencies, since the iris or window itself acts as a filter element.

Thus, there has been provided a simple, efficient, compact coupling mechanism for resonant cavities.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A cavity resonator including a housing having interior cavities with top and bottom walls, a coupling window having spaced side walls formed between adjacent cavities, a slot formed in said top wall extending in a direction across said spaced side walls, a coupling element supported from the top wall by a securing element which extends through said slot, said securing element being moveable along said slot to permit lateral adjustment of the coupling element between the spaced side walls of said coupling window.

2. A cavity resonator as in claim 1 in which said coupling element has smooth walls.

3. A cavity resonator as in claim 2 in which said coupling element is cylindrical.

4. A cavity resonator as in claim 1 in which said securing means comprises a screw.

* * * * *